US009200473B2

(12) United States Patent
Fan et al.

(10) Patent No.: US 9,200,473 B2
(45) Date of Patent: Dec. 1, 2015

(54) REKEYABLE LOCK CYLINDER, REKEYABLE PADLOCK AND METHOD OF REKEYING

(75) Inventors: Wai Kuen Fan, Kowloon (HK); Bernhard Garthe, Gevelsberg (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 1174 days.

(21) Appl. No.: 13/182,556

(22) Filed: Jul. 14, 2011

(65) Prior Publication Data

US 2013/0014548 A1 Jan. 17, 2013

(51) Int. Cl.

| | |
|---|---|
| ***E05B 27/04*** | (2006.01) |
| ***E05B 67/24*** | (2006.01) |
| ***E05B 9/08*** | (2006.01) |
| ***E05B 27/00*** | (2006.01) |

(52) U.S. Cl.

CPC ..... *E05B 9/084* (2013.01); *E05B 27/005* (2013.01); *E05B 67/24* (2013.01); *Y10T 70/446* (2015.04); *Y10T 70/7667* (2015.04)

(58) Field of Classification Search

CPC ... E05B 27/00; E05B 27/005; E05B 27/0035; E05B 27/0053; E05B 27/006; E05B 27/0064; E05B 27/0067; E05B 27/0085; E05B 27/0089; E05B 27/02; E05B 27/083; E05B 35/08; E05B 35/083; E05B 35/10; E05B 35/125; E05B 35/00; E05B 9/084; E05B 67/24; Y10T 70/446; Y10T 70/7667

USPC ..... 70/337–343, 382–385, 493, 495, 419, 70/421, 378, 373, 375, DIG. 1, DIG. 3, 70/DIG. 4, DIG. 5, DIG. 37, DIG. 44, 70/DIG. 62, 38 A, 368, 371

See application file for complete search history.

(56) References Cited

U.S. PATENT DOCUMENTS

| | | | | | |
|---|---|---|---|---|---|
| 2,247,621 | A | * | 7/1941 | Speer | 70/493 |
| 2,977,786 | A | * | 4/1961 | Kendrick et al. | 70/493 |
| 3,073,146 | A | * | 1/1963 | Patriquin | 70/383 |
| 3,181,320 | A | * | 5/1965 | Bauer | 70/421 |
| 3,209,568 | A | * | 10/1965 | Patriquin | 70/373 |
| 3,303,678 | A | * | 2/1967 | Bernard et al. | 70/373 |
| 3,349,588 | A | * | 10/1967 | Hines | 70/493 |
| 3,928,991 | A | * | 12/1975 | Gaul et al. | 70/493 |
| 4,196,604 | A | * | 4/1980 | Vorob | 70/358 |
| 4,351,171 | A | * | 9/1982 | Tsui | 70/339 |
| 4,380,163 | A | * | 4/1983 | Reder | 70/493 |
| 4,393,673 | A | | 7/1983 | Widen | |
| 4,635,455 | A | | 1/1987 | Oliver | |
| 4,829,798 | A | | 5/1989 | Roop | |
| 5,363,678 | A | | 11/1994 | Meckbach | |
| 5,377,511 | A | | 1/1995 | Meckbach | |

(Continued)

*Primary Examiner* — Lloyd Gall

(74) *Attorney, Agent, or Firm* — Gifford, Krass, Sprinkle, Anderson & Citkowski, P.C.

(57) ABSTRACT

A rekeyable lock cylinder and a padlock with a rekeyable lock cylinder includes a cylindrical core formed to receive a key and an outer casing formed around the core. The cylinder core may be provided with one or more reconfiguration channels. Pins and springs mounted in openings formed in a spring holder connected to the casing can be removed through the one or more reconfiguration channels when the reconfiguration channels in the core align with assembly openings in the casing and the pin openings in the spring holder, thereby allowing the adaptation of the number of pins mounted in the lock cylinder to the number of cuts provided in the key.

19 Claims, 6 Drawing Sheets

(56) References Cited

U.S. PATENT DOCUMENTS

| | | | | |
|---|---|---|---|---|
| 6,105,404 | A * | 8/2000 | Field et al. | 70/365 |
| 6,314,774 | B1 * | 11/2001 | Andersson | 70/358 |
| 6,425,274 | B1 | 7/2002 | Laitala et al. | |
| 6,519,988 | B1 * | 2/2003 | Wu | 70/358 |
| 6,951,123 | B2 * | 10/2005 | Chong | 70/493 |
| 7,121,127 | B1 * | 10/2006 | Fan | 70/373 |
| 8,584,495 | B2 * | 11/2013 | Chiou et al. | 70/371 |
| 2003/0089148 | A1 * | 5/2003 | Ruan | 70/386 |
| 2003/0154752 | A1 * | 8/2003 | Price | 70/358 |
| 2004/0226327 | A1 * | 11/2004 | Chou | 70/358 |
| 2005/0183481 | A1 * | 8/2005 | Lee | 70/358 |
| 2005/0183482 | A1 * | 8/2005 | Lin | 70/493 |
| 2008/0307842 | A1 * | 12/2008 | Villani | 70/493 |
| 2010/0300161 | A1 * | 12/2010 | Lin | 70/134 |

* cited by examiner

REKEYABLE LOCK CYLINDER, REKEYABLE PADLOCK AND METHOD OF REKEYING

BACKGROUND OF THE INVENTION

1. Field of the Invention

This invention pertains to padlocks and lock cylinders. More particularly, this invention pertains to a rekeyable padlock and lock cylinder.

2. Description of the Prior Art

Keyable lock cylinders are known in the art, and are used, for example, in keyable padlocks, such as the ones described in U.S. Pat. Nos. 5,363,678 and 5,377,511 issued to Meckbach on Nov. 15, 1994 and Jan. 3, 1995 and U.S. Pat. No. 6,425,274 issued to Laitala et al. on Jul. 30, 2002, respectively, and hereby incorporated by reference in their entirety. Keyable lock cylinders, keyable padlocks or such as these are not typically sold to end users, but rather are first "keyed" by a locksmith and then sold to users. For example, if a consumer purchases one or more lock cylinders or padlocks, it is desirable that the consumer be able to key each of the padlocks to operate with a particular key, such as the consumer's house key. Thus, the consumer would not have to maintain separate and additional keys for each individual lock cylinder or padlock. The lock cylinders or padlocks are provided to a locksmith with a zero-bitted key, meaning that the key has two long, generally parallel edges with no cuts. The locksmith inserts the zero-bitted key into a rotatable core of the cylinder. A stop pin limits rotation of the rotatable core of the cylinder. The stop pin must be removed from the cylinder or—in case of a spring biased stop pin—depressed in order to complete the rotation of the core to align the key profile with a longitudinal row of pin openings or a rectangular slot in an outer casing of the cylinder.

The locksmith determines a pin sequence for each padlock. Specifically, the locksmith selects a predetermined number of key pins to insert in the key pin openings of the core of the cylinder, with each key pin having a specific length and with the key pins ordered in a particular sequence. Generally, a lock cylinder accommodates between 3 and 7 key pins. Typically, the key pins used in a key pin sequence are selected from a group of key pins having a variety of pin lengths.

After the pin sequence is selected and before inserting the key pins through the pin openings, the zero-bitted key is removed from the key profile and a cut key is then inserted into the key profile. One edge of such cut key is cut such that the number, size, and order of cuts in the edge of the key correspond to the number, length, and order of the key pins of the selected pin sequence. The selected pins are inserted into the key pin openings in the specified order of the pin sequence. After all of the key pins are inserted, a shear line is formed and the key is rotated until the key pins are aligned with driver pins and springs that prevent rotation of the cylinder core without the matching key.

Such keyed lock cylinders or padlocks can also be rekeyed to a different particular cut key similar to the above-mentioned procedure. In this procedure the matching original key, i.e. the key the lock cylinder was initially keyed for, is used instead of the zero-bitted key.

As mentioned above, a lock cylinder may accommodate between three and seven key pins. Most common are lock cylinders with five or six key pins. However, keying a lock cylinder having six key pins to a key being cut for a five-pin lock cylinder would result in an inoperative lock cylinder as the free key pin which does not match with any cut of the key would not be able to depress the corresponding driver pin. In other words, the shear line could not be formed, and the cylinder core would be permanently blocked. Frequently, customers desire that a lock cylinder with five key pins be rekeyed to a six key pin type of lock cylinder. As a consequence, a locksmith must spend considerable time for rekeying, i.e. adapting the lock cylinders to customers' needs, particularly when the core must be detached from the lock cylinder so that the unneeded driver pin and the related spring can be removed. This procedure also bears the danger that parts of the lock cylinder get lost.

What is needed is a simplified method, lock cylinder and padlock that enables a consumer or locksmith to key or rekey the lock cylinder or the padlock to a particular cut key and a variable number of pins the key is cut for.

The present invention provides a solution to these and other problems and offers other advantages over the prior art, as will be understood with reference to the summary, the detailed description and the drawings.

SUMMARY OF THE INVENTION

According to the present invention, a rekeyable lock cylinder and a padlock with a rekeyable lock cylinder formed within are provided. The lock cylinder includes a rotatable cylindrical core having a cylindrical outer surface and a front end face. The cylindrical core defines a key profile sized for receiving a key. The key profile extends from the front end face axially into the cylindrical core. The cylindrical core comprises a plurality of key pin openings that extend radially through the cylindrical core between the cylindrical outer surface and the key profile. The lock cylinder also includes a casing including a cylindrical portion and a spring-holding portion. The cylindrical portion has a casing wall that defines a cylindrical inner chamber which supports the cylindrical core. The cylindrical portion comprises at least one keying opening extending through the casing wall. The spring-holding portion comprises a plurality of driver pin openings exposed to the inner chamber of the cylindrical portion. The driver pin openings extend in a radial direction relative to the cylindrical core and comprise a rear-most driver pin opening located farthest from the front end face of the cylindrical core. A plurality of key pins are accommodated in the key pin openings; and a plurality of driver pins are accommodated in the driver pin openings. Each driver pin is biased toward the cylindrical core by a spring. The cylindrical core is rotatable within the cylindrical inner chamber at least between a locked position in which the key pin openings align with the driver pin openings and a first rekeyable position in which the key pin openings align with the at least one keying opening such that the key pins can be replaced by other key pins through the at least one keying opening. The casing comprises an access opening which provides access to the rear-most driver pin opening, such that the corresponding driver pin can be removed from the rear-most driver pin opening or inserted into the rear-most driver pin opening through the access opening without removing the cylindrical core. The advantages of this access opening include a greater flexibility and a considerable reduction in time in rekeying. Since a rekeying between keys having different numbers of cuts does not require removing the cylindrical core, the rekeying process is fast, easy and fail-safe.

The access opening preferably is different from said at least one keying opening.

According to a preferred embodiment of the present invention, the access opening is formed in the cylindrical portion of the casing and is in alignment with the rear-most driver pin opening of the spring-holding portion, wherein the cylindrical core comprises a reconfiguration channel that extends radially through the cylindrical core between opposite sides of the cylindrical outer surface. The cylindrical core is further rotatable to a second rekeyable position in which the reconfiguration channel aligns with the access opening and the rear-most driver pin opening. The rear-most driver pin can be removed or inserted through the reconfiguration channel. The first and second rekeyable positions can be different from each other such that the key pins are prevented from unintentionally falling out of the key pin openings while the rear-most driver pins are removed or inserted.

According to another preferred embodiment of the present invention, the access opening is formed in the spring-holding portion of the casing, wherein the rear-most driver pin opening is a through-hole extending to the access opening. The rear-most driver pin can be removed in the first rekeyable position, i.e. without moving the core into a second rekeyable position, such that the rekeying process is simplified.

In this embodiment, the access opening preferably is closed by a removable closure comprising a plate which is movably retained in at least one groove (preferably two grooves) provided in the spring-holding portion of the casing. If the lock cylinder has a longitudinal axis (e.g. axis of rotation of the cylindrical core), the plate preferably is movable only in a transverse direction with respect to the longitudinal axis. Despite being optionally removable (for removing the rear-most driver pin), the plate is thus securely attached to the casing of the lock cylinder since the plate can be surrounded and thereby blocked at the casing of the lock cylinder by a structure that accommodates the lock cylinder (e.g. inner part or inner surface of the padlock body blocking the plate against movement in the transverse direction).

DESCRIPTION OF THE PREFERRED EMBODIMENT

Referring to the several drawing figures in which identical elements are numbered identically or incremented by 100, a description of the preferred embodiments will now be provided. In providing such a description, specific methods and parts of the invention will be described. It will be appreciated that variants (some of which will be later described) of such specifics are intended to be included within the scope of the appended claims.

Figure 1:
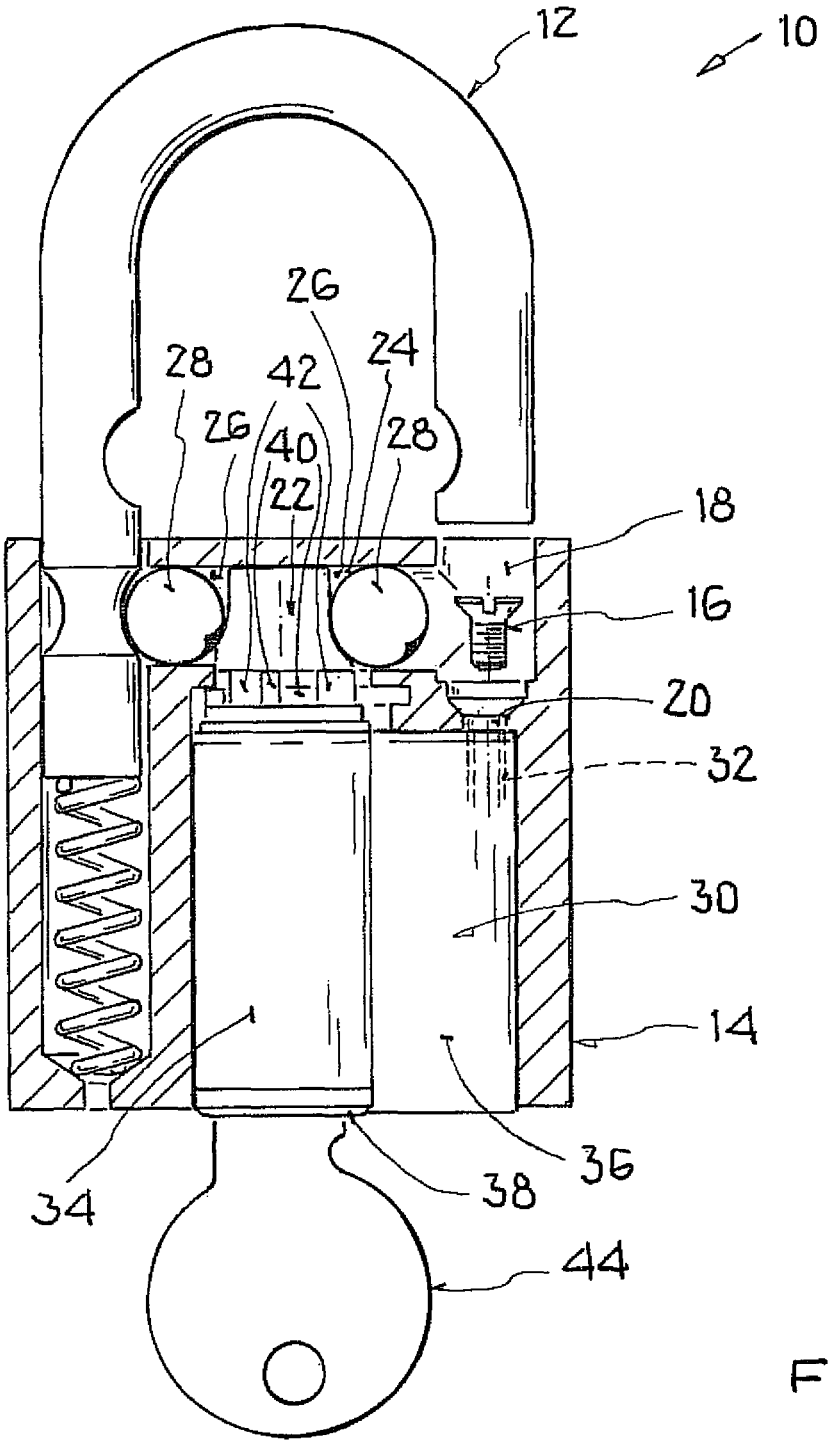
FIG. 1 is a view in vertical section of a padlock according to the present invention.

Referring to FIG. 1, a rekeyable padlock 10 is shown. The padlock shown has a padlock body 14 with generally the same configuration as the ones described in U.S. Pat. Nos. 5,363,678, 5,377,511 and 6,425,274, previously incorporated by reference herein. A description of the padlock 10, shown in FIG. 1 follows. However, it will be apparent that a variety of configurations of the actual padlock body 14 can by used in accordance with the present invention.

The padlock 10 includes a U-shaped shackle 12 and accommodates a removable lock cylinder 30 that fits within the padlock body 14. A removable threaded screw 16 extends through the bottom end 20 of a bore 18 incorporated in the padlock body 14 and engages a threaded bore 32 of the lock cylinder 30 to retain the lock cylinder 30 within the padlock body 14. The screw 16 can be removed, and the lock cylinder 30 thereby released from the padlock body 14, only when the shackle 12 is open.

Figure 6A:
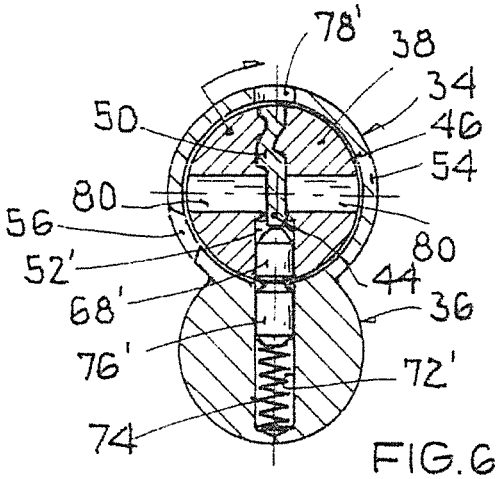
FIG. 6A to 6F are rear views in vertical section of the lock cylinder according to the first embodiment along a transverse plane extending through the rear-most key pin opening and driver pin opening in different rotational positions of the core.
Figure 10:
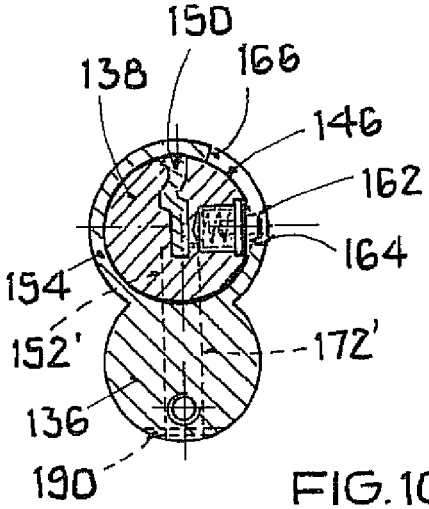
FIG. 10 is a rear view in vertical section of the lock cylinder along a transverse plane extending through a stop pin according to the second embodiment.
Figure 11A:
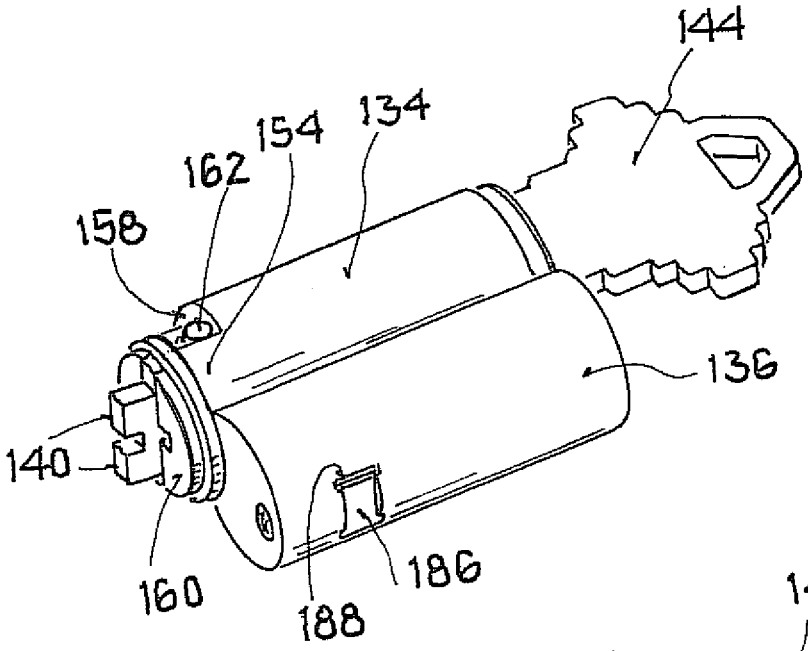
FIGS. 11A and 11B are perspective views of the lock cylinder according to the second embodiment.
Figure 11B:
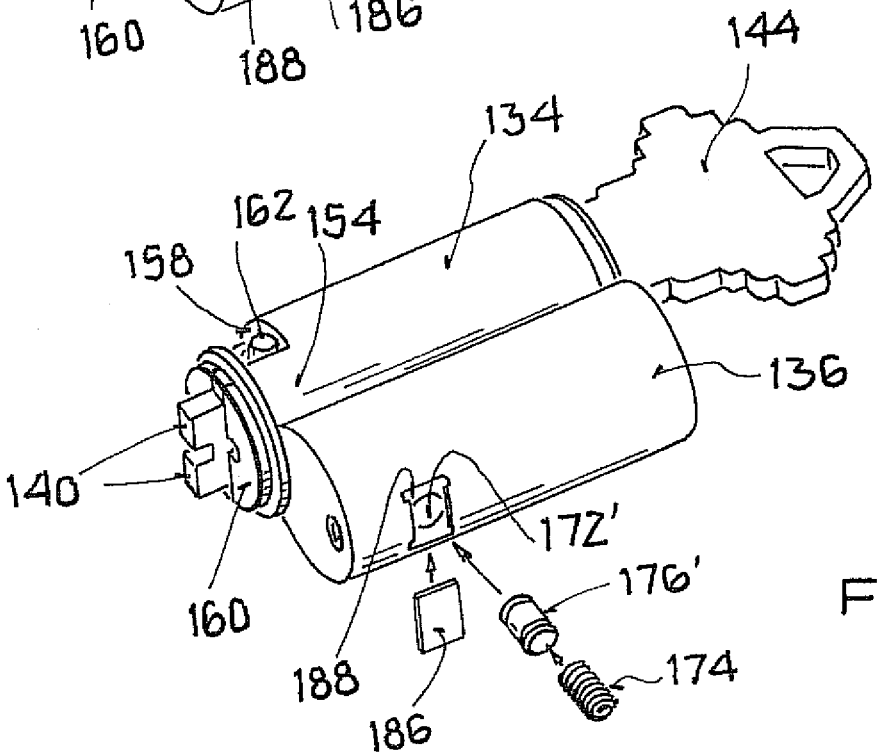

The lock cylinder 30 has a casing with a cylindrical portion 34 and an attached spring-holding portion 36, which together generally form a FIG. 6A or FIG. 10 cross section. The cylindrical portion 34 has a rotatable cylindrical core 38 and entrainment projections 40 that engage with entrainment projections 42 of a rotatable element 22 positioned within a transverse slot 24 of the lock body 14.

After a key 44 is inserted into the core 38 of the lock cylinder 30, and while the key 44 is being rotated from a locked position to an unlocked position, the element 22 is thereby rotated until its grooves 26 receive portions of balls 28, respectively, so that the shackle 12 is free to move upwardly until the lock is opened.

Figure 2A:
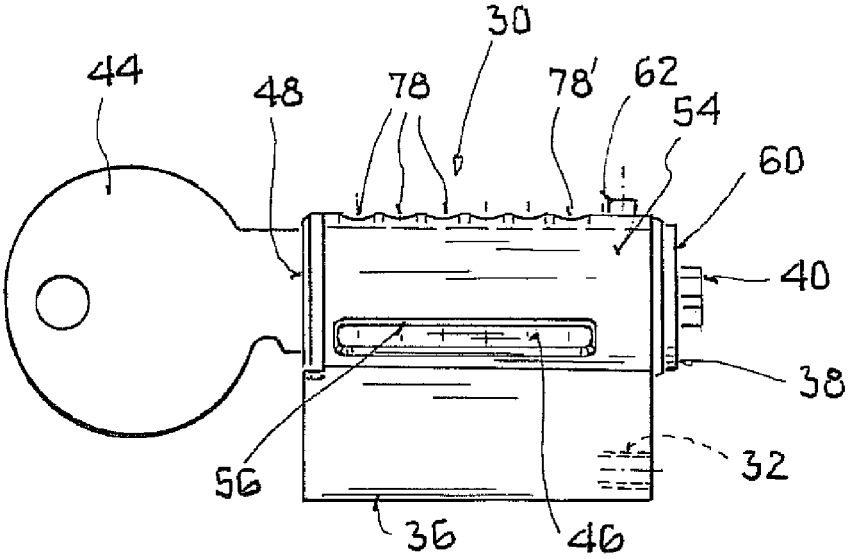
FIGS. 2A and 2B are side views of a 6-pin lock cylinder according to a first embodiment of the present invention in a locked position.
Figure 2B:
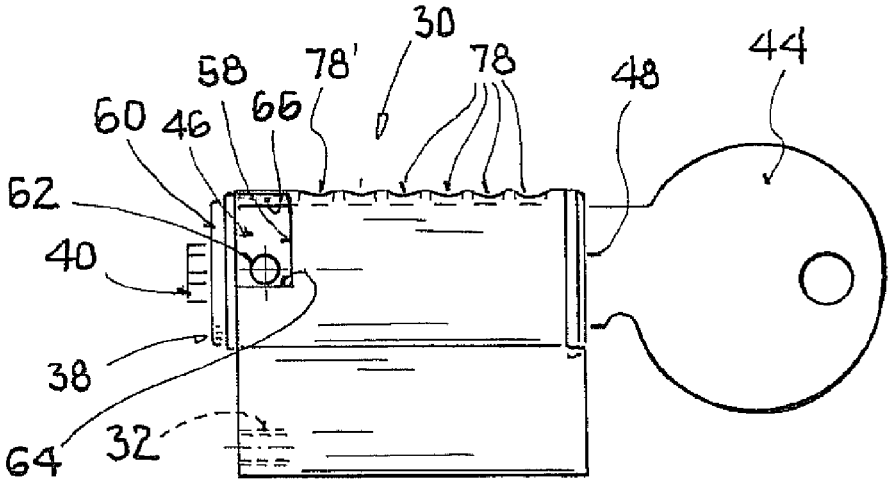
Figure 3:
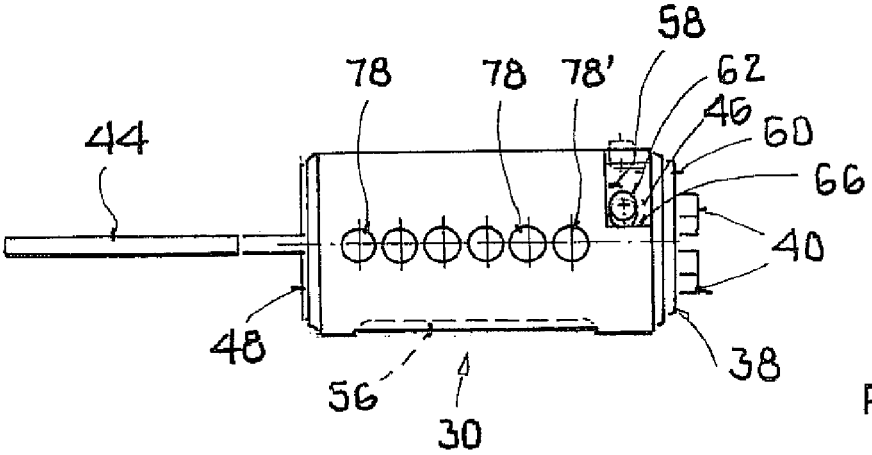
FIG. 3 is a top view of the lock cylinder according to the first embodiment in a locked position.
Figure 4:
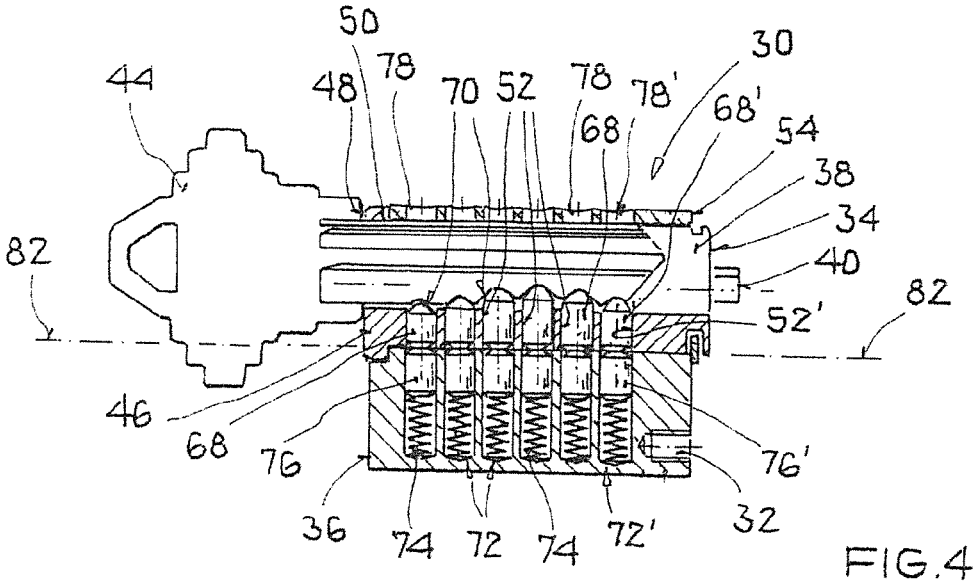
FIG. 4 is a side view in vertical section of the lock cylinder according to the first embodiment in a locked position taken generally longitudinally through the assembly openings with a six-cut key inserted.
Figure 5:
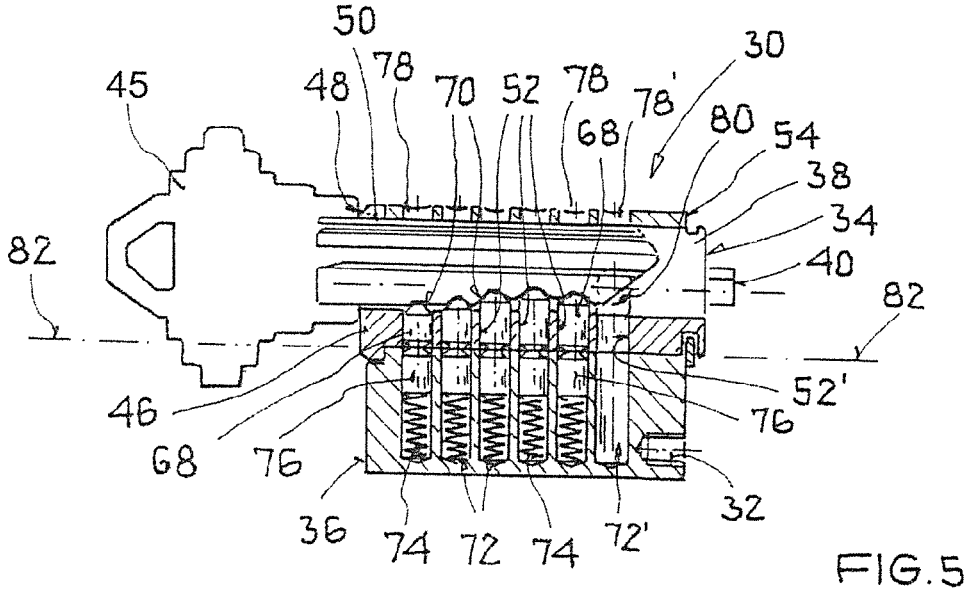
FIG. 5 is a side view in vertical section of the lock cylinder according to the first embodiment with one pin removed in a locked position taken generally longitudinally through the assembly openings with a five-cut key inserted.

Referring now to FIGS. 2A-6F, the lock cylinder 30 according to a first embodiment is shown in isolation from the padlock body 14. Such lock cylinder could also be used in door locks. The core 38 is generally cylindrical and includes a cylindrical outer surface 46 (FIGS. 2A, 2B, 4 and 5) and a front end face 48 (FIGS. 4 and 5). As best shown in FIGS. 4 and 5, a key profile 50 extends from the front end face 48 axially into the core 38. The core 38 also defines six key pin openings 52, including a rear-most key pin opening 52' as seen from the front end face 48, that extend radially through the core 38 between the outer surface 46 and the key profile 50.

The cylindrical portion 34 of the lock cylinder 30 includes a casing wall 54. The casing wall 54 defines a cylindrical inner chamber in which the core 38 is rotatably mounted.

A keying opening 56 (FIGS. 2A and 6A to 6F) is arranged as a longitudinal slot extending through the casing wall 54. In one preferred embodiment described below, the keying opening 56 is formed as a continuous slot extending through the casing wall 54. However, the keying opening may be formed in different shapes and with different dimensions, and more than one keying opening may be formed within the casing wall 54 without departing from the spirit of the present invention. In one preferred embodiment, the keying opening 56 is positioned approximately 75 degrees counter-clockwise around the axis of the cylindrical portion 34 from the bottom of the lock cylinder 30, i.e. from the longitudinal middle plane of the spring-holding portion 36, seen from the front end face 48 (FIGS. 6A to 6F show a view from the rear side). In the normally locked rotational position of the core 38, as shown in FIGS. 2A, 2B, 3, 4, 5, 6A and 6F, the key pin openings 52, 52' align with the longitudinal middle plane of the spring-holding portion 36. By rotating the core 38 by 75 degrees with help of key 44 counter-clockwise relative to the casing wall 54, the core 38 can be placed in a first rekeyable position in which the key pin openings 52, 52' align with the keying opening 56 (see FIGS. 6B and 6E). By rotating the core 38 another 15 degrees counter-clockwise, i.e. a total of 90 degrees counter-clockwise from the normally locked position, the core 38 can be placed in a second rekeyable position which will be described in the following (see FIGS. 6C and 6D).

The casing wall 54 includes a generally rectangular cutout 58 adjacent the rear end 60 of the core 38. As shown in FIGS. 2B and 3, a portion of a spring-biased stop pin 62 located in the core 38 extends into the cutout 58 of the casing wall 54. The cutout 58 forms opposing first and second edges 64 and 66 in the casing wall 54 that limit rotation of the core 38 when the stop pin 62 abuts either of the edges 64 or 66 as shown in FIGS. 2B and 3.

Figure 6B:
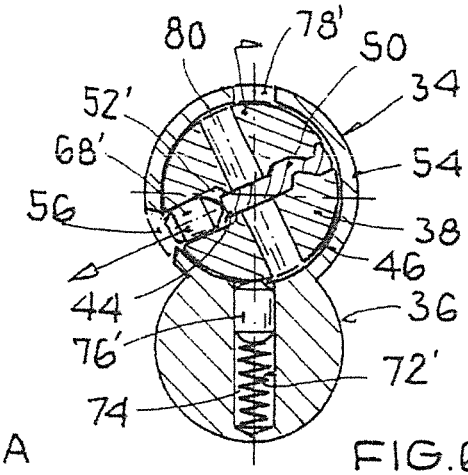

When the stop pin 62 abuts the first edge 64, the core 38 is aligned in the normally locked position of FIGS. 2A, 2B, 3, 4, 5, 6A and 6F. The stop pin 62 abuts the second edge 66 of the cutout 58 to prevent unlimited rotation when the core 38 is rotated (e.g., by key 44 clockwise from the locked position). In one preferred embodiment, the core rotates about 65 degrees between the two edges 64 and 66. The stop pin 62 may be depressed until it is flush with the outer surface 46 of the core 38. Thus, when the stop pin 62 is depressed, the core 38 may continue to be rotated beyond the limited range set by the edges 64 and 66. This allows the core 38 to be rotated until the core 38 is positioned such that, e.g., the row of key pin openings 52, 52' is visible through keying opening 56, as shown in FIGS. 6B and 6E. The stop pin 62 of the present invention, therefore, allows quick and easy access to the key pin openings 52, 52' without having to use a tool to remove the stop pin, and without having to safeguard the stop pin when rekeying the lock cylinder 30.

Specifically, as shown in FIGS. 2B and 3, depressing the stop pin 62 permits rotation of the core 38 into rekeyable positions. In a first rekeyable position, key pin openings 52, 52' are longitudinally aligned along keying opening 56. This allows the lock to be rekeyed by replacing key pins 68 (or core pins), including a rear-most key pin 68', located in the key pin openings 52, 52' through the keying opening 56. In the preferred embodiment, the keying opening 56 in casing wall 54 is formed such that its circumferential dimension is larger than a diameter of each key pin opening 52, 52'. Hence, when rekeying, a user can view portions of the outer surface 46 that surround the key pin openings 52, 52'.

FIG. 4 shows a cross-sectional view of the lock cylinder 30 in the locked position with a selected pin sequence and the key 44 inserted in the key profile 50. As is known in the art, the spring holding portion 36 of the lock cylinder 30 defines six driver pin openings 72 including a rear-most driver pin opening 72', each provided with a coil spring 74 and a driver pin 76 (or locking pin or casing pin). When the core 38 of the cylindrical portion 34 is in the normally locked position, the key pin openings 52, 52' align with the driver pin openings 72, 72'. Thus, each of the driver pin openings 72, 72' is in axial alignment with one of the key pins 68, 68'. This causes the key pins 68, 68' to be biased upwardly by the coil springs 74 when no key is in the lock.

The casing wall 54 is further provided with six assembly openings 78, including a rear-most assembly opening 78', which are positioned approximately 180 degrees around the axis of the cylindrical portion 34 from a longitudinal center of the spring-holding portion 36, i.e., on top of the lock cylinder 30. The assembly openings 78, 78' are aligned with the key cylinder 30. The assembly openings 78, 78' are aligned with the key pin openings 52, 52' when the core 38 is in the normally locked position. The assembly openings 78, 78' provide access to the driver pin openings 72, 72' for inserting the coil springs 74 and driver pins 76, including a rear-most driver pin 76', during the initial assembly process, i.e., when the cylindrical core 38 is detached from the lock cylinder 30. The rear-most assembly opening 78' forms an access opening that allows for removing or inserting the rear-most driver pin 76' also without removing the cylindrical core 38, as explained below.

It should be noted that all of the driver pin openings 72, 72' are closed at the bottom side of the lock cylinder, i.e. the driver pin openings 72, 72' are blind holes in the spring-holding portion 36. The driver pins 76, 76' have a cylindrical outer surface over their entire length, i.e. without an abutment collar flat forms a radial broadening. It is thus possible to insert the driver pins 76, 76' into the driver pin openings 72, 72' through the assembly openings 78, 78' during assembly of the lock cylinder 30.

Figure 6C:
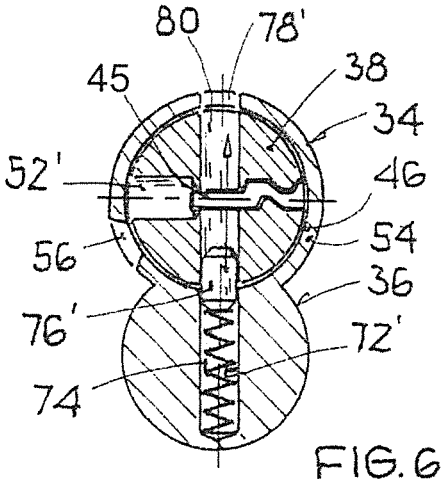
Figure 6D:
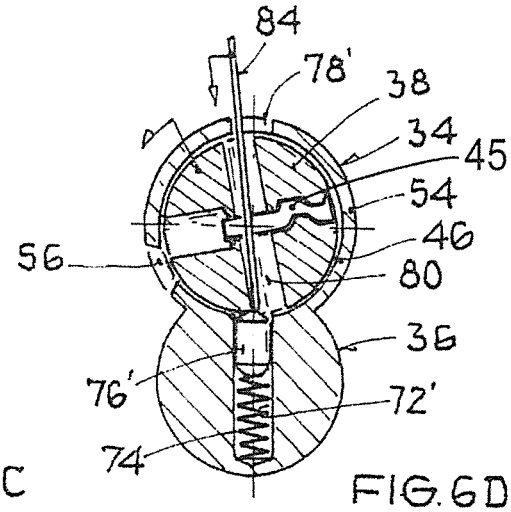
Figure 6E:
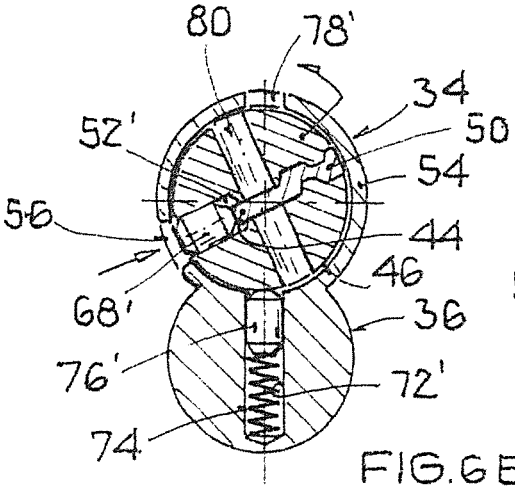

The core 38 further includes a radial reconfiguration channel 80 extending in the plane of the rear-most key pin openings 52' and intersecting the key profile 50 at 90 degrees (see FIGS. 5 and 6A to 6F). The reconfiguration channel 80 extends between opposite sides of the outer surface 46. In other words, the reconfiguration channel 80 preserves its diameter along the complete diameter of the cylindrical core 38, contrary to a typical key pin opening (such as key pin opening 52' in FIG. 6A). The reconfiguration channel 80 is in alignment with the rear-most driver pin opening 72' and the rear-most assembly opening 78' (as seen from the front end face 48) when the core 38 is rotated into the second rekeyable position as depicted in FIGS. 6C and 6D (rotated 90 degrees counter-clockwise from the normally locked position).

As shown in FIG. 4, when the key 44 is inserted into the key profile 50, the cuts 70 of the key 44 complement the key pins 68, 68' such that an outwardly facing end of each of the key pins 68, 68' is flush with the outer surface 46 of the core 38. If the key pins 68, 68' have the appropriate lengths that correspond to the cuts 70, the key pins 68, 68' hold the driver pins 76, 76' flush with the outer surface 46 of the core 38 when the key 44 is inserted in the key profile 50. If any one of the cuts 70 of the key 44 does not match its corresponding key pin 68, 68', then, depending on the type of mismatch, either the respective driver pin 76, 76' engaging into the core 38 or the respective key pin 68, 68' engaging into the driver pin opening 72, 72' will prevent rotation of the core 38.

Figure 6F:
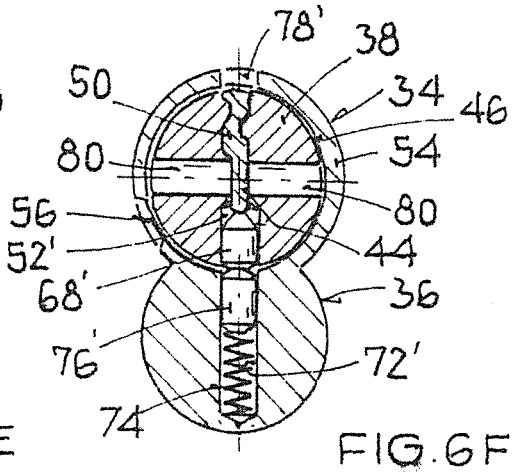

When rekeying a lock, a pin sequence is selected. The pin sequence includes a particular number of key pins 68, 68' with selected pin lengths. Depending on the key pins 68, 68' held in the core 38, a zero-bitted key or the original cut key 44 is used to rotate the core 38 to the first rekeyable position as shown in FIG. 6B after depressing the stop pin 62 (FIGS. 2B and 3). The key is then removed. A new key 44 for which the lock cylinder 30 should be keyed for and which is cut in a cut sequence corresponding to the selected pin sequence is inserted into the key profile 50 of the lock cylinder 30. The original key pins 68, 68' are then removed from the key pin openings 52, 52' and replaced by the selected key pins 68, 68'. The new key 44 is then used to rotate the core 38 back to the normally locked position as shown in FIGS. 6A and 6F.

Generally, a pin sequence may be selected by choosing pins from a variety of lengths that the lock cylinder 30 can accommodate. For example, in one preferred embodiment of the present invention, the lock cylinder 30 can accommodate ten different pin lengths, and thus, the cuts 70 of the key 44 can be selected from ten different cut sizes that correspond to the ten different pin lengths.

If the number of cuts 70 of the new key differs from the number of cuts of the original key, also the number of key pins 68, 68' and driver pins 76, 76' has to be adapted to the number of cuts 70 of the new key. The present invention allows for reconfiguring the lock cylinder 30 with respect to the number of key pins 68, 68' and driver pins 76, 76' used to cooperate with the cuts 70 of the respective key.

When rekeying a lock configured for a six-cut key 44 (see FIG. 4) for use with a five-cut key 45 (see FIG. 5), first the zero-bitted key or the original cut key 44 is used to rotate the core 38 to the first rekeyable position as shown in FIG. 6B. The six-cut key 44 is then removed. The new five-cut key 45 is inserted into the key profile 50 of the lock cylinder 30 and the six original key pins 68, 68' are removed from the key pin openings 52, 52' through the keying opening 56 and replaced by five selected key pins 68, 68' which match to new key 45. The key 45 is then used to rotate the core 38 further on into the second rekeyable position as shown in FIG. 6C. In this position, the coil spring 74 and the driver pin 76' located in the rear-most driver pin opening 72' can be removed through the reconfiguration channel 80 and the rear-most assembly opening 78' (access opening). The core 38 is then rotated back to the locked position, thereby allowing stop pin 62 to snap back into cut-out 58.

If—vice versa—such a lock configured for a five-cut key 45 (see FIG. 5) should be rekeyed for use with a six-cut key 44 (FIG. 4), first the five-cut key 45 is used to rotate the core 38 to the second rekeyable position as shown in FIG. 6D. In this position, the coil spring 74 and the driver pin 76' are inserted in the rear-most driver pin opening 72' through the rear-most assembly opening 78' (access opening) and the reconfiguration channel 80 and depressed by means of a thin rod 84 below a shear line 82 defined by the outer surface 46 (see FIG. 5). The core 38 is then rotated into the first rekeyable position as shown in FIG. 6E. Thereby, the driver pin 76 inserted in the rear-most core pin opening 72' is retained by the outer surface 46 of the core 38 already after a marginal rotation of the core 38 so that the rod 84 can be removed and the rotation into the first rekeyable position can be completed. In the first rekeyable position the five-cut key 45 is replaced by the six-cut key 44. The five key pins 68 selected for the five-cut key 45 are replaced by six key pins 68 including the rear-most key pin 68' selected for the six-cut key 44. The core 38 is then rotated back to the locked position (FIG. 6F).

In both cases it is not necessary to detach the cylindrical core 38 from the lock cylinder 30 in order to remove or insert the rear-most driver pin 76' and associated coil spring 74.

As understood by those skilled in the art, the angular position of the keying opening 56 with respect to the driver pin openings 72, 72' or the assembly openings 78, 78' on the one hand and the angular position of the reconfiguration channel 80 with respect to the key pin openings 52, 52' and/or the key profile 50 on the other hand may differ from the angle disclosed for the embodiment described above. Instead any angular position could be selected in that the first and second rekeyable positions are either different from one another or identical. In the latter case, the angular position of the keying opening 56 may for example be spaced by 90 degrees from each of the driver pin opening 72' and the assembly opening 78'.

Referring now to FIGS. 7 to 11B, a lock cylinder 130 according to a second embodiment is shown in isolation from the padlock body 14. Such lock cylinder could be used in the padlock 10 of FIG. 1 instead of and in the same configuration as the lock cylinder 30 as well as in door locks.

The lock cylinder 130 has a casing with a cylindrical portion 134 and an attached spring-holding portion 136. The cylindrical portion 134 has a rotatable cylindrical core 138 and entrainment projections 140 that can engage with the entrainment projections 42 of the rotatable element 22 of the padlock 10 of FIG. 1.

Figure 7:
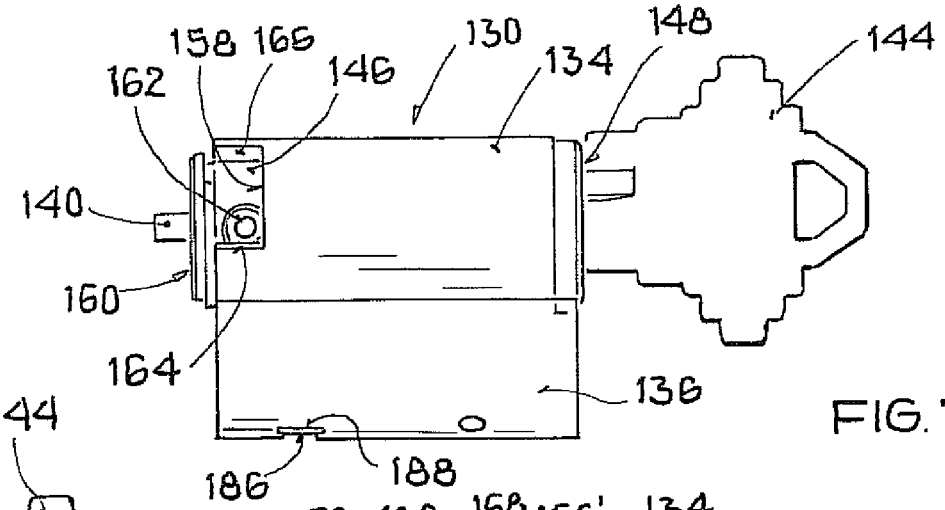
FIG. 7 is a side view of a 6-pin lock cylinder according to a second embodiment of the present invention.
Figure 8:
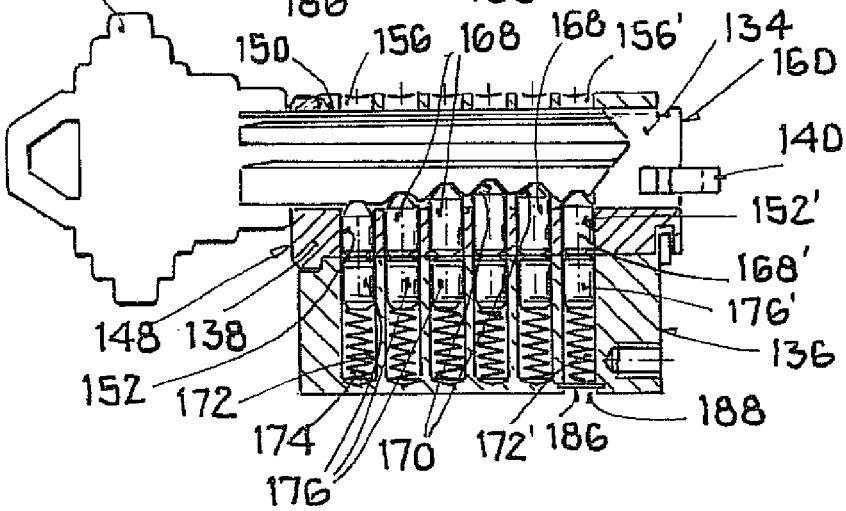
FIG. 8 is a side view in vertical section of the lock cylinder according to the second embodiment in a locked position taken generally longitudinally through the keying openings with a six-cut key inserted.

The core 138 is generally cylindrical and includes a cylindrical outer surface 146 and a front end face 148 (FIGS. 7 and 8). As best shown in FIG. 8, a key profile 150 for receiving a key 144 extends from the front end face 148 axially into the core 138. The core 138 also defines six key pin openings 152, including a rear-most key pin opening 152', that extend radially through the core 138 between the outer surface 146 and the key profile 150. Each key pin opening 152, 152' accommodates a key pin 168, 168'.

The cylindrical portion 134 of the lock cylinder 130 includes a casing wall 154. The casing wall 154 defines a cylindrical inner chamber in which the core 138 is rotatably mounted.

Individual keying openings 156, including a rear-most keying opening 156' (FIGS. 8 and 9), are formed as bores extending through the casing wall 154. Instead of a plurality of keying openings 156, 156' a single keying opening (such as keying opening 56 of the first embodiment) could be provided. Preferably, the keying openings 156, 156' are positioned on top of the cylindrical portion 134, i.e. in the longitudinal middle plane of the lock cylinder 130 seen from the front end face 148. In the normally locked position of the core 138 (FIG. 8) the key pin openings 152, 152' align with the longitudinal middle plane of the lock cylinder 130. By rotating the core 138 by 180 degrees with help of key 144 relative to the casing wall 154, the core 138 can be placed in a rekeyable position in which the key pin openings 152, 152' align with the keying openings 156, 156'.

The casing wall 154 includes a generally rectangular cutout 158 adjacent the rear end 160 of the core 138. As shown in FIGS. 7, 10, 11A and 11B, a portion of a spring-biased stop pin 162 located in the core 138 extends into the cutout 158 of the casing wall 154. The cutout 158 forms opposing first and second edges 164 and 166 in the casing wall 154 that limit rotation of the core 138 when the stop pin 162 abuts either of the edges 164 or 166 as shown in FIGS. 7, 10, 11A and 11B.

When the stop pin 162 abuts the first edge 164, the core 138 is aligned in the normally locked position of FIGS. 7, 8, 10, 11A and 11B. The stop pin 162 abuts the second edge 166 of the cutout 158 to prevent unlimited rotation when the core 138 is rotated (e.g., by key 144 clockwise from the locked position). In one preferred embodiment, the core rotates about 70 degrees between the two edges 164 and 166. The stop pin 162 may be depressed until it is flush with the outer surface 146 of the core 138. Thus, when the stop pin 162 is depressed, the core 138 may continue to be rotated beyond the limited range set by the edges 164 and 166. This allows the core 138 to be rotated into the rekeyable position, i.e. until the core 138 is positioned such that, e.g., the row of key pin openings 152, 152' is visible through keying openings 156, 156'. The stop pin 162, therefore, allows quick and easy access to the key pin openings 152, 152' without having to use a tool to remove the stop pin, and without having to safeguard the stop pin when rekeying the lock cylinder 130.

The keying openings 156, 156' also serve as assembly openings and provide access to driver pin openings 172, 172' for inserting coil springs 174 and driver pins 176, 176' during the initial assembly process, i.e., when the core 138 is detached from the lock cylinder 130.

Figure 9:
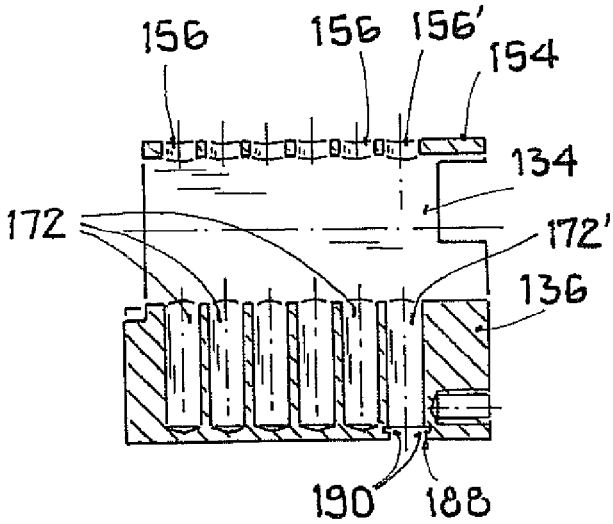
FIG. 9 is a side view in vertical section of the casing of the lock cylinder according to the second embodiment.

FIG. 8 shows a cross-sectional view of the lock cylinder 130 in the locked position with a selected pin sequence and the key 144 inserted in the key profile 150. As also shown in FIG. 9, the spring holding portion 136 of the lock cylinder 130 defines six driver pin openings 172, including a rear-most driver pin opening 172' (as seen from the front end face 148), each provided with a coil spring 174 and a driver pin 176 (or locking pin or casing pin) including a rear-most driver pin 176'. Whereas the five driver pin openings 172 are configured as blind holes, the rear-most driver pin opening 172' is a through hole which is terminated by a removable plate 186 acting as stop for the corresponding spring 174. An additional access opening 188 giving access to the driver pin opening 172' is provided by a generally rectangular cutout at the bottom side of the spring holding portion 136 adjacent the rear end 160 of the core 138. The access opening 188 surrounds the rear-most driver pin opening 172' and is provided with opposing transverse grooves 190 which receive the plate 186.

When the core 138 of the cylindrical portion 134 is in the normally locked position (FIG. 8), the driver pin openings 172, 172' align with the key pin openings 152, 152'. Thus, each of the driver pin openings 172, 172' is in axial alignment with one of the key pins 168, 168'. This causes the key pins 168, 168' to be biased upwardly by the coil springs 174 when no key is in the lock. In this case the key pins 168, 168' abut at the end of the respective key pin opening 152, 152' within the cylindrical core 138 (the transverse width of the key profile 150 being smaller than the diameter of the key pin openings 152, 152' or diameter of the key pins 168, 168', as illustrated in dashed lines in FIG. 10).

Rotating the core 138 into its rekeyable position allows the lock to be rekeyed by replacing the key pins 168, 168' located in the key pin openings 152, 152' through the keying openings 156, 156'.

When the key 144 is inserted into the key profile 50, the cuts 170 of the key 144 complement the key pins 168 such that an outwardly facing end of each of the key pins 168, 168' is flush with the outer surface 146 of the core 138. If the key pins 168, 168' have the appropriate lengths that correspond to the cuts 170, the key pins 168 hold the driver pins 176, 176' flush with the outer surface 146 of the core 138 when the key 144 is inserted in the key profile 150. If any one of the cuts 170 of the key 144 does not match its corresponding key pin 168, 168', then, depending on the type of mismatch, either the extension of the corresponding driver pin 176, 176' into the core 138 or the extension of the key pin 168, 168' into the driver pin opening 172, 172' will prevent rotation of the core 138.

As explained for the first embodiment, when rekeying a lock, a pin sequence is selected. The pin sequence includes a particular number of key pins 168, 168' with selected pin lengths. After removing the lock cylinder 130 from the associated padlock body 14, a zero-bitted key or the original cut key 144 is used to rotate the core 138 to the rekeyable position after depressing the stop pin 162 (FIGS. 7, 10, 11A and 11B). The key is then removed. A new key 144 for which the lock cylinder 130 should be keyed for and which is cut in a cut sequence corresponding to the selected pin sequence is inserted into the key profile 150 of the lock cylinder 130. The original key pins 168, 168' are then removed from the key pin openings 152, 152' and replaced by the selected key pins 168, 168'. The new key 144 is then used to rotate the core 138 back to the normally locked position.

If the number of cuts 170 of the new key differs from the number of cuts of the original key, also the number of key pins 168, 168' and driver pins 176, 176' has to be adapted to the number of cuts 170 of the new key. The second embodiment provides for a particularly simple solution for reconfiguring the lock cylinder 150 with respect to the number of the key pins 168, 168' and driver pins 176, 176' used to cooperate with the same number of cuts 170 of the respective key.

When rekeying a lock configured for a six-cut key 144 (see FIG. 8) for use with a five-cut key, first the zero-bitted key or the original cut key 144 is used to rotate the core 138 by 180 degrees to the rekeyable position. The key 144 is then removed. The new five-cut key is inserted into the key profile 150 of the lock cylinder 130 and the six original key pins 168, 168' are removed from the key pin openings 152, 152' through the keying openings 156, 156' and replaced by five selected key pins 168 which match to the new key. The rear-most pin opening 152' corresponding to the driver rear-most pin opening 172' remains empty.

Contrary to the first embodiment, the driver pin 176' accommodated in the rear-most driver pin opening 172' is not removed through the rear-most keying opening 156', since the cylindrical core 138 does not have a reconfiguration channel extending at full diameter (of the driver pin opening 172') along the complete diameter of the core 138. Instead the plate 186 is removed in a transverse direction from the grooves 190, and the coil spring 174 and the driver pin 176 are removed from the rear-most driver pin opening 172' through the access opening 188. Then the driver pin opening 172' is re-closed by the plate 186. Finally, the new key is used to rotate core 138 back to the locked position, thereby allowing stop pin 162 to snap back into cutout 158. The lock cylinder 130 is then again inserted into the associated padlock body 14.

Since the plate 186 is removable in a transverse direction only (with respect to the longitudinal axis of the lock cylinder), the plate 186 is not unintentionally released from the access opening 188 at the spring holding portion 136 even if the lock cylinder 130 is subjected to mechanical vibrations. Particularly, an inner part or inner surface of the padlock body 14 can block the plate 186 against unintentional release from the access opening 188 when the lock cylinder 130 is accommodated in the padlock body 14.

If—vice versa—such a lock configured for a five-cut key should be rekeyed for use with a six-cut key 144 (FIG. 8), after removing the lock cylinder 130 from the associated padlock body 14 the five-cut key is used to rotate the core 138 to the rekeyable position. In this position, plate 186 is removed from the grooves 190 and the coil spring 174 and the driver pin 176' are inserted into the rear-most driver pin opening 172' through the access opening 188. Then the driver pin opening 172' is re-closed by the plate 186 (see FIG. 11B). The five-cut key is replaced by the six-cut key 144. The five key pins 168 selected for the five-cut key are replaced by six key pins 168, 168' selected for the six-cut key 144. These six key pins 168, 168' are inserted into the key pin openings 152, 152' through the keying openings 156, 156'. The core 138 is then rotated back to the locked position (FIG. 8). The lock cylinder 130 is then again inserted into the associated padlock body 14.

Again, in both cases it is not necessary to detach the cylindrical core 138 from the lock cylinder 130 in order to remove or insert the rear-most driver pin 176' and associated coil spring 174.

From the foregoing, it has been shown how the present invention has been attained in preferred embodiments. Modifications and equivalents of the disclosed concepts, such as those which are apparent to one skilled in the art, are intended to be included within the scope of the appended claims.

For example, more than one key pin and driver pin may selectively be removed from or inserted into the lock cylinder 30 or 130 by forming two or more rear-most driver pin openings and associated access openings as explained above.

REFERENCE NUMERAL LIST

10 padlock
12 shackle
14 padlock body
16 screw
18 bore
20 bottom end
22 element
24 slot
26 groove
28 ball
30, 130 lock cylinder
32 threaded bore
34,134 cylindrical portion
36, 136 spring-holding portion
38, 138 core
40, 42, 140 entrainment projections
44, 45, 144 key
46, 146 outer surface
48, 148 front end face
50, 150 key profile
52, 52',
152, 152' key pin opening
54, 154 casing wall
56, 156,
156' keying opening
58, 158 cutout
60, 160 rear end
62, 162 stop pin
64, 66,
164, 166 edge
68, 68',
168, 168' key pin
70, 170 cut
72, 72',
172, 172' driver pin opening
74, 174 coil spring
76, 76',
176, 176' driver pin
78, 78' assembly opening
80 reconfiguration channel
82 sheer line
84 rod
186 plate
188 access opening
190 groove

The invention claimed is:

1. A rekeyable lock cylinder, the lock cylinder comprising:

a rotatable cylindrical core having a cylindrical outer surface and a front end face, the cylindrical core defining a key profile sized for receiving a key, the key profile extending from the front end face axially into the cylindrical core, the cylindrical core comprising a plurality of key pin openings that extend radially through the cylindrical core between the cylindrical outer surface and the key profile;

a casing including a cylindrical portion and a spring-holding portion, the cylindrical portion having a casing wall defining a cylindrical inner chamber which supports the cylindrical core, the cylindrical portion comprising at least one keying opening extending through the casing wall, wherein the spring-holding portion comprises a plurality of driver pin openings exposed to the inner chamber of the cylindrical portion, the driver pin openings extending in a radial direction relative to the cylindrical core and comprising a rear-most driver pin opening located farthest from the front end face of the cylindrical core;

a plurality of key pins associated with the key pin openings; and a plurality of driver pins associated with the driver pin openings, each driver pin being biased toward the cylindrical core by a spring;

wherein the cylindrical core is rotatable within the cylindrical inner chamber at least between a locked position in which the key pin openings align with the driver pin openings and a first rekeyable position in which the key pin openings align with the at least one keying opening such that the key pins can be replaced by other key pins through the at least one keying opening;

wherein the casing comprises an access opening which provides access to the rear-most driver pin opening, such that the driver pin associated with the rear-most driver pin opening can be removed from or inserted into the rear-most driver pin opening through the access opening without removing the cylindrical core; and wherein the access opening is formed in the cylindrical portion of the casing and is in alignment with the rear-most driver pin opening of the spring-holding portion, wherein the cylindrical core comprises a reconfiguration channel that extends radially through the cylindrical core between opposite sides of the cylindrical outer surface;

the cylindrical core being further rotatable to a second rekeyable position in which the reconfiguration channel aligns with the access opening and the rear-most driver pin opening.

2. The lock cylinder of claim 1, wherein the at least one keying opening comprises a single keying window sized to expose all of the key pin openings, when the cylindrical core is in the first rekeyable position.

3. The lock cylinder of claim 1, wherein the diameter of the reconfiguration channel along its entire length is at least as great as the diameter of the rear-most driver pin opening.

4. The lock cylinder of claim 1, wherein the reconfiguration channel extends perpendicularly to the alignment of the key pin opening associated with the rear-most driver pin opening in a plane perpendicular to the axis of rotation of the cylindrical core.

5. The lock cylinder of claim 1, wherein the first rekeyable position is different from the second rekeyable position.

6. The lock cylinder of claim 1, wherein the first rekeyable position and the second rekeyable position are identical.

7. The lock cylinder of claim 1, wherein each driver pin opening is formed as a blind hole that is closed at the bottom of the spring-holding portion of the casing.

8. The lock cylinder of claim 1, wherein the cylindrical core has a rear end face positioned oppositely to the front end face, the reconfiguration channel being arranged adjacent to the rear end face.

9. A rekeyable padlock comprising a lock cylinder in accordance with claim 1 and further comprising:

a padlock body and a shackle, the lock cylinder being removably accommodated in the padlock body.

10. A method of rekeying a lock cylinder having a number of key pins which correspond to an original key by replacing said key pins by a number of key pins which correspond to a new key selected by a user, the new key having a number of cuts, wherein the number of cuts of the new key is different from the number of cuts of the original key, the method comprising:

providing a lock cylinder, the lock cylinder having:

a rotatable cylindrical core having a cylindrical outer surface and a front end face, the cylindrical core defining a key profile sized for receiving a key, the key profile extending from the front end face axially into the cylindrical core, the cylindrical core comprising a plurality of key pin openings that extend radially through the cylindrical core between the cylindrical outer surface and the key profile;

a casing including a cylindrical portion and a spring-holding portion, the cylindrical portion having a casing wall defining a cylindrical inner chamber which supports the cylindrical core, the cylindrical portion comprising at least one keying opening extending through the casing wall, wherein the spring-holding portion comprises a plurality of driver pin openings exposed to the inner chamber of the cylindrical portion, the driver pin openings extending in a radial direction relative to the cylindrical core and comprising a rear-most driver pin opening located farthest from the front end face of the cylindrical core;

a plurality of key pins associated with the key pin openings; and a plurality of driver pins associated with the driver pin openings, each driver pin being biased toward the cylindrical core by a spring;

wherein the cylindrical core is rotatable within the cylindrical inner chamber at least between a locked position in which the key pin openings align with the driver pin openings and a first rekeyable position in which the key pin openings align with the at least one keying opening such that the key pins can be replaced by other key pins through the at least one keying opening; and wherein the casing comprises an access opening which provides access to the rear-most driver pin opening, such that the corresponding driver pin can be removed from the rear-most driver pin opening or inserted into the rear-most driver pin opening through the access opening;

the method further comprising:

inserting the original key into the key profile of the cylindrical core;

moving the cylindrical core into the first rekeyable position;

removing the original key from the key profile;

inserting the new key into the key profile;

replacing, without removing the cylindrical core, the key pins which correspond to the original key by the key pins which correspond to the new key through the at least one keying opening such that each of the key pins fits within the corresponding cut of the new key; and removing or inserting, without removing the cylindrical core, the driver pin from or into the rear-most driver pin opening;

wherein the key pin accommodated in a rear-most key pin opening is removed through the at least one keying opening and the driver pin accommodated in the rear-most driver pin opening is removed through the access opening if the number of cuts of the new key is smaller than the number of cuts of the original key, or wherein the key pin associated with a rear-most key pin opening is inserted through the at least one keying opening and the driver pin associated with the rear-most driver pin opening is inserted through the access opening if the number of cuts of the new key is greater than the number of cuts of the original key;

wherein the access opening is formed in the cylindrical portion of the casing and is in alignment with the rear-most driver pin opening of the spring-holding portion, wherein the cylindrical core comprises a reconfiguration channel that extends radially through the cylindrical core between opposite sides of the cylindrical outer surface;

the cylindrical core being further rotatable to a second rekeyable position in which the reconfiguration channel aligns with the access opening and the rear-most driver pin opening;

the method further comprising:

moving the cylindrical core to the second rekeyable position prior to removing or inserting the driver pin associated with the rear-most driver pin opening;

wherein the driver pin associated with the rear-most driver pin opening is removed or inserted through the access opening and the reconfiguration channel.

11. The method of claim 10, wherein the access opening is formed in the spring-holding portion of the casing, and wherein the rear-most driver pin opening is a through-hole extending to the access opening.

12. The method of claim 11, wherein the access opening is closed by a removable closure;

the method further comprising:

removing the closure prior to removing or inserting the driver pin associated with the rear-most driver pin opening; and closing the access opening with the closure after removing or inserting the driver pin associated with the rear-most driver pin opening.

13. A rekeyable lock cylinder, the lock cylinder comprising:

a rotatable cylindrical core having a cylindrical outer surface and a front end face, the cylindrical core defining a key profile sized for receiving a key, the key profile extending from the front end face axially into the cylindrical core, the cylindrical core comprising a plurality of key pin openings that extend radially through the cylindrical core between the cylindrical outer surface and the key profile;

a casing including a cylindrical portion and a spring-holding portion, the cylindrical portion having a casing wall defining a cylindrical inner chamber which supports the cylindrical core, the cylindrical portion comprising at least one keying opening extending through the casing wall, wherein the spring-holding portion comprises a plurality of driver pin openings exposed to the inner chamber of the cylindrical portion, the driver pin openings extending in a radial direction relative to the cylindrical core and comprising a rear-most driver pin opening located farthest from the front end face of the cylindrical core;

a plurality of key pins associated with the key pin openings; and a plurality of driver pins associated with the driver pin openings, each driver pin being biased toward the cylindrical core by a spring;

wherein the cylindrical core is rotatable within the cylindrical inner chamber at least between a locked position in which the key pin openings align with the driver pin openings and a first rekeyable position in which the key pin openings align with the at least one keying opening such that the key pins can be replaced by other key pins through the at least one keying opening;

wherein the casing comprises an access opening which provides access to the rear-most driver pin opening, such that the driver pin associated with the rear-most driver pin opening can be removed from or inserted into the rear-most driver pin opening through the access opening without removing the cylindrical core;

wherein the access opening is formed in the spring-holding portion of the casing, wherein the rear-most driver pin opening is a through-hole extending to the access opening; and wherein all driver pin openings except for the rear-most driver pin opening are formed as blind holes that are closed at the bottom of the spring-holding portion of the casing.

14. The lock cylinder of claim 13, wherein the access opening is closed by a removable closure.

15. The lock cylinder of claim 14, wherein the closure comprises a plate which is movably retained in at least one groove provided in the spring-holding portion of the casing.

16. The lock cylinder of claim 15, wherein the lock cylinder has a longitudinal axis defined by an axis of rotation of the cylindrical core, the plate being movable only in a transverse direction with respect to the longitudinal axis.

17. A rekeyable padlock comprising a lock cylinder in accordance with claim 13 and further comprising:

a padlock body and a shackle, the lock cylinder being removably accommodated in the padlock body.

18. The padlock of claim 17, wherein the access opening is closed by a removable plate which is movably retained in at least one groove provided in the spring-holding portion of the casing, wherein the lock cylinder has a longitudinal axis defined by an axis of rotation of the cylindrical core, the plate being movable only in a transverse direction with respect to the longitudinal axis, and wherein the padlock body blocks the plate against being removed from the casing of the lock cylinder when the lock cylinder is accommodated in the padlock body.

19. A method of rekeying a lock cylinder having a number of key pins which correspond to an original key by replacing said key pins by a number of key pins which correspond to a new key selected by a user, the new key having a number of cuts, wherein the number of cuts of the new key is different from the number of cuts of the original key, the method comprising:

providing a lock cylinder, the lock cylinder having:

a rotatable cylindrical core having a cylindrical outer surface and a front end face, the cylindrical core defining a key profile sized for receiving a key, the key profile extending from the front end face axially into the cylindrical core, the cylindrical core comprising a plurality of key pin openings that extend radially through the cylindrical core between the cylindrical outer surface and the key profile;

a casing including a cylindrical portion and a spring-holding portion, the cylindrical portion having a casing wall defining a cylindrical inner chamber which supports the cylindrical core, the cylindrical portion comprising at least one keying opening extending through the casing wall, wherein the spring-holding portion comprises a plurality of driver pin openings exposed to the inner chamber of the cylindrical portion, the driver pin openings extending in a radial direction relative to the cylindrical core and comprising a rear-most driver pin opening located farthest from the front end face of the cylindrical core;

a plurality of key pins associated with the key pin openings; and a plurality of driver pins associated with the driver pin openings, each driver pin being biased toward the cylindrical core by a spring;

wherein the cylindrical core is rotatable within the cylindrical inner chamber at least between a locked position in which the key pin openings align with the driver pin openings and a first rekeyable position in which the key pin openings align with the at least one keying opening such that the key pins can be replaced by other key pins through the at least one keying opening; and wherein the casing comprises an access opening which provides access to the rear-most driver pin opening, such that the corresponding driver pin can be removed from the rear-most driver pin opening or inserted into the rear-most driver pin opening through the access opening;

the method further comprising:

inserting the original key into the key profile of the cylindrical core;

moving the cylindrical core into the first rekeyable position;

removing the original key from the key profile;

inserting the new key into the key profile;

replacing, without removing the cylindrical core, the key pins which correspond to the original key by the key pins which correspond to the new key through the at least one keying opening such that each of the key pins fits within the corresponding cut of the new key; and removing or inserting, without removing the cylindrical core, the driver pin from or into the rear-most driver pin opening;

wherein the key pin accommodated in a rear-most key pin opening is removed through the keying at least one opening and the driver pin accommodated in the rear-most driver pin opening is removed through the access opening if the number of cuts of the new key is smaller than the number of cuts of the original key, or wherein the key pin associated with a rear-most key pin opening is inserted through the at least one keying opening and the driver pin associated with the rear-most driver pin opening is inserted through the access opening if the number of cuts of the new key is greater than the number of cuts of the original key;

wherein the access opening is formed in the spring-holding portion of the casing, and wherein the rear-most driver pin opening is a through-hole extending to the access opening; and wherein all driver pin openings except for the rear-most driver pin opening are formed as blind holes that are closed at the bottom of the spring-holding portion of the casing.

* * * * *